US009919408B2

(12) United States Patent
Ebbesson

(10) Patent No.: US 9,919,408 B2
(45) Date of Patent: Mar. 20, 2018

(54) STAPLE GUN

(71) Applicant: Isaberg Rapid AB, Hestra (SE)

(72) Inventor: Jan Ebbesson, Åsenhoega (SE)

(73) Assignee: Isaberg Rapid AB, Hestra (SE)

( * ) Notice: Subject to any disclaimer, the term of this patent is extended or adjusted under 35 U.S.C. 154(b) by 413 days.

(21) Appl. No.: 14/646,828

(22) PCT Filed: Oct. 31, 2013

(86) PCT No.: PCT/SE2013/000167
§ 371 (c)(1),
(2) Date: May 22, 2015

(87) PCT Pub. No.: WO2014/081365
PCT Pub. Date: May 30, 2014

(65) Prior Publication Data

US 2015/0273675 A1 Oct. 1, 2015

(30) Foreign Application Priority Data

Nov. 23, 2012 (SE) ..... 1200718-3

(51) Int. Cl.
*B25C 5/11* (2006.01)

(52) U.S. Cl.
CPC ..... *B25C 5/11* (2013.01)

(58) Field of Classification Search
CPC ..... B25C 5/11
(Continued)

(56) References Cited

U.S. PATENT DOCUMENTS 4,126,260 A * 11/1978 Mickelsson ..... B25C 5/10 227/132
7,665,644 B2 * 2/2010 Hu ..... B25C 5/11 227/132

(Continued)

FOREIGN PATENT DOCUMENTS

CN 2086651 U 10/1991
CN 2671756 Y 1/2005

(Continued)

OTHER PUBLICATIONS

International Search Report of PCT/SE2013/000167, dated Feb. 21, 2014.

(Continued)

*Primary Examiner* — Nathaniel Chukwurah
(74) *Attorney, Agent, or Firm* — Collard & Roe, P.C.

(57) ABSTRACT

Staple gun for driving staples into a workpiece includes a frame with a driver conveyable upward and downward. In the downward movement, the driver executes a drive stroke driving the staple. In the upward movement, an activation member conveys the driver to a highest height and releases the driver to execute the drive stroke. An elongated elastic member has a first end coupled to the driver and a second end to a bearing pin assigned to the frame. A first breakpoint pin is placed between the bearing pin and the driver at a first distance from the bearing pin, and a second breakpoint pin between the driver and the first breakpoint pin is arranged at a second distance from the bearing pin and is movable between first and second positions disengaging and engaging the elastic member, respectively. The first distance is related to the highest height as 1.6-2.0:1.

7 Claims, 9 Drawing Sheets

(58) Field of Classification Search
USPC ..... 227/120, 132, 140, 156
See application file for complete search history.

(56) References Cited

U.S. PATENT DOCUMENTS

| | | | |
|---|---|---|---|
| 2003/0155400 | A1 | 8/2003 | Jairam et al. |
| 2008/0223901 | A1 | 9/2008 | Tsai et al. |
| 2008/0308599 | A1 | 12/2008 | Marks |
| 2009/0272781 | A1 | 11/2009 | Maemori et al. |
| 2010/0187279 | A1 | 7/2010 | Lin |
| 2011/0297725 | A1 | 12/2011 | Huang |

FOREIGN PATENT DOCUMENTS

| | | | |
|---|---|---|---|
| DE | 27 12 294 | A1 | 11/1977 |
| GB | 2480936 | A | 12/2011 |
| WO | 96/38267 | A1 | 12/1996 |

OTHER PUBLICATIONS

Extended European Search Report in EP 13 85 6994, dated Aug. 26, 2016.

* cited by examiner

STAPLE GUN

CROSS REFERENCE TO RELATED APPLICATIONS

This application is the National Stage of PCT/SE2013/000167 filed on Oct. 31, 2013, which claims priority under 35 U.S.C. § 119 of Sweden Application No. 1200718-3 filed on Nov. 23, 2012, the disclosure of which is incorporated by reference. The international application under PCT article 21(2) was published in English.

TECHNICAL FIELD

The present invention relates to a staple gun for driving staples into a workpiece, which gun comprises a frame, arranged in which is a driver, which can be conveyed in an up and downward movement and which in the downward movement executes a drive stroke, in which a staple is driven, and which by means of an activation member can be conveyed in the upward movement to a highest height, at which the activation member releases the driver for execution of the drive stroke, and which driver is coupled to a first end of an elongated elastic member, which is tensioned when the driver is conveyed in the upward movement for execution of the drive stroke, and which is in engagement at a second end to a bearing pin arranged to the frame as well as a first breakpoint pin placed between the bearing pin and the driver at a first distance from the bearing pin and around which the elastic member is bent and tensioned when the driver is conveyed in the upward movement as well as a second breakpoint pin placed between the driver and the first breakpoint pin at a second distance from the bearing pin and arranged so that it can be conveyed between a first position, in which it does not engage with the elastic member when this is conveyed by the driver in the upward movement, and a second position, in which it engages with the elastic member when the driver is conveyed in the upward movement and tensions the member.

PRIOR ART

Staple guns of the type indicated above are common and are found in a large number of designs. Every well-stocked tool store more often than not offers several designs of such guns for sale.

Depending on the material into which a staple is to be driven, the degree to which the elastic member needs to be tensioned varies when the driver has been conveyed to its highest position. This means that when a great force is required, the elastic member must be strongly tensioned, while when a smaller force is required, the member can be tensioned less. When a great force is required, this has been accomplished by the elongated elastic member being made thick and thereby strongly tensioned and when a smaller force is required, said member has been made thin. Since the force is produced by bending the member around a breakpoint pin and since the upward movement of the driver is not varied, the tensioning is the same regardless of whether a great or small force is required.

This means that when a workpiece requiring low force is exposed to the force from a staple gun with a powerfully designed member, the workpiece easily becomes deformed by the impact of the driver against the workpiece, which, if the workpiece is clearly visible, is often perceived as aesthetically objectionable When a staple gun with a weaker member is used for a workpiece that requires high force, it occurs that the staple is not driven sufficiently into the workpiece, which can mean that the object that one intends to attach to the workpiece is not attached satisfactorily.

These disadvantages have been overcome in more expensive staple guns such that a second breakpoint pin has been introduced, which can be conveyed between an active position in which the elastic member is bent around the pin, and an inactive position in which the pin does not cooperate with the elastic member. With such a solution it has been achieved that the staple gun can be set in various impact force positions and thereby avoid aesthetically disturbing impact marks in the workpiece or poor driving of the staple. However, it has not been possible to vary the impact force in any of these previous staple guns in such a way that the gun has been able to be used for material where a very small force is required and a material where a large force is required.

Problem

A desire thus exists to provide a staple gun in which it is possible to vary the impact force within a very large range.

Solution to the Problem

The present invention provides a staple gun in which said problem is solved by a staple gun of the aforementioned type, which is characterised by that the first distance at which the first breakpoint pin is placed from the bearing pin is related to the drivers highest height of the upward movement as 1.6-2.0:1.

The invention is further characterised by that said ratio is 1.7-1.9:1.

The invention is characterised still further by that said ratio is 1.8:1.

The invention is further characterised by that the second distance at which the second breakpoint pin is placed from the bearing pin is related to the highest height of the upward movement as 3.1-3.7:1.

In addition, the invention is characterised by that the last-named ratio is 3.3-3.5:1.

Furthermore, the invention is characterised by that the last-named ratio is 3.4:1.

Finally, the invention is characterised by that the second breakpoint can be conveyed to a position in which it makes contact with the elastic member when the driver is raise half of the distance h.

BRIEF DESCRIPTION OF FIGURES

The invention is to be described in detail below with reference to the enclosed figures, in which.

PREFERRED EMBODIMENT

Figure 1:
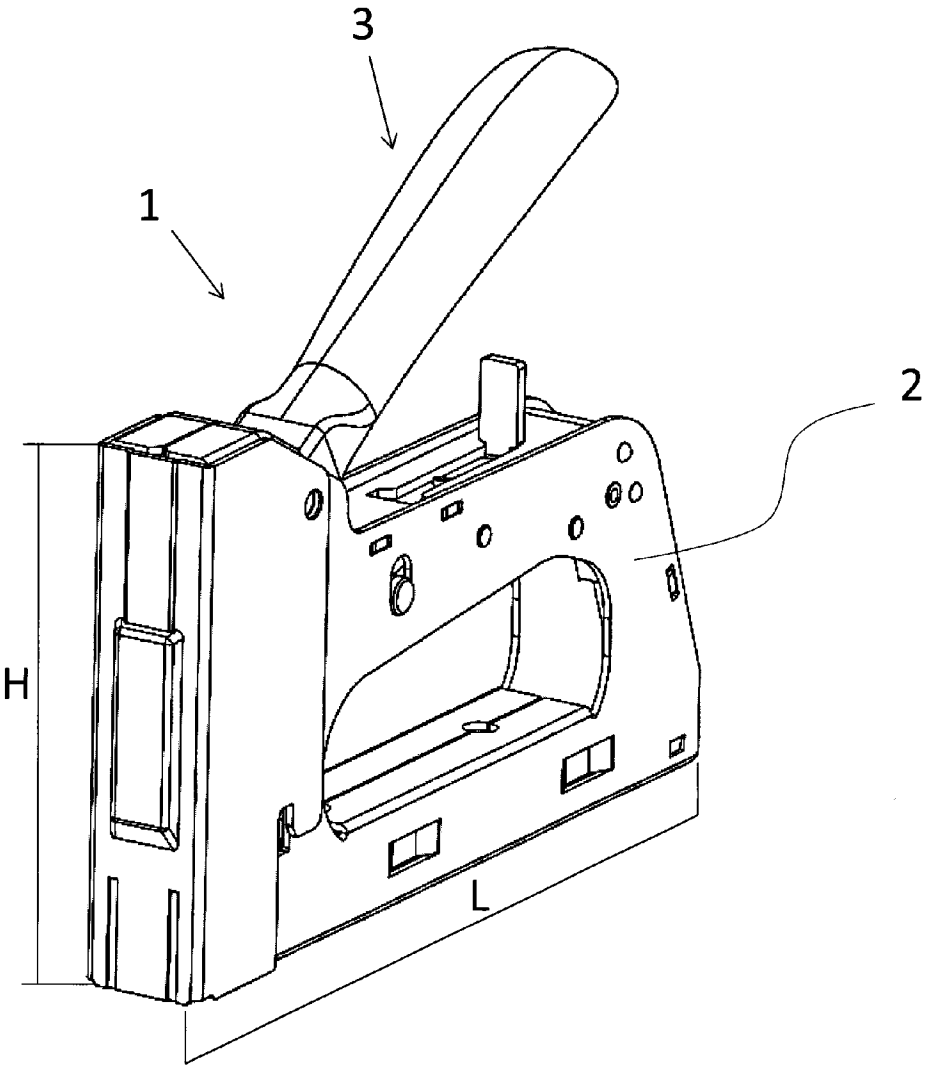
FIG. 1 shows a staple gun viewed obliquely from the front.

FIG. 1 shows a staple gun 1, which comprises a frame 2, which has the length L and the height H. Arranged to the frame is an activation member 3, the function of which will be described below. A driver 4 is evident from FIG. 2, which driver is supported in a manner known to the person skilled in the art in a longitudinal edge area 5 of the frame in such a way that it can be conveyed by the activation member in an upward movement U. A workpiece 6 is further evident from the figure as well as staples 7.

Figure 2:
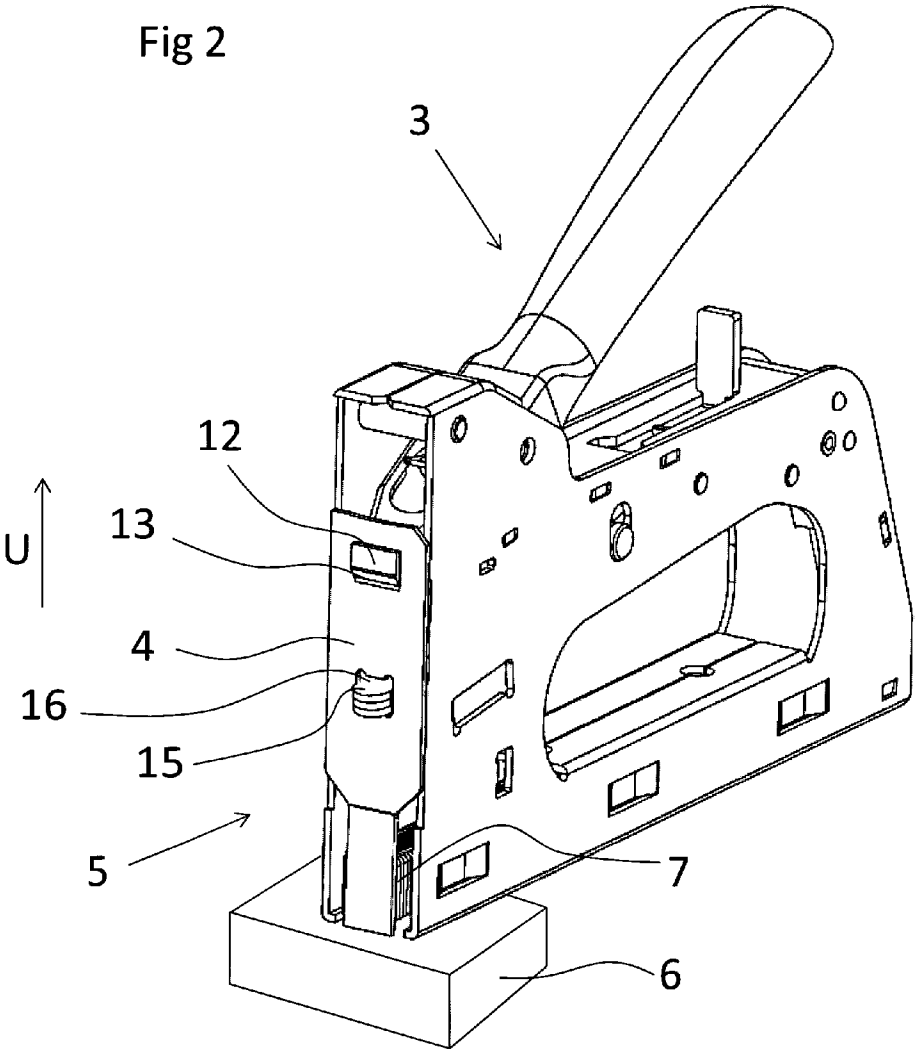
FIG. 2 shows a view corresponding to FIG. 1 in which the front part has been exposed.
Figure 3:
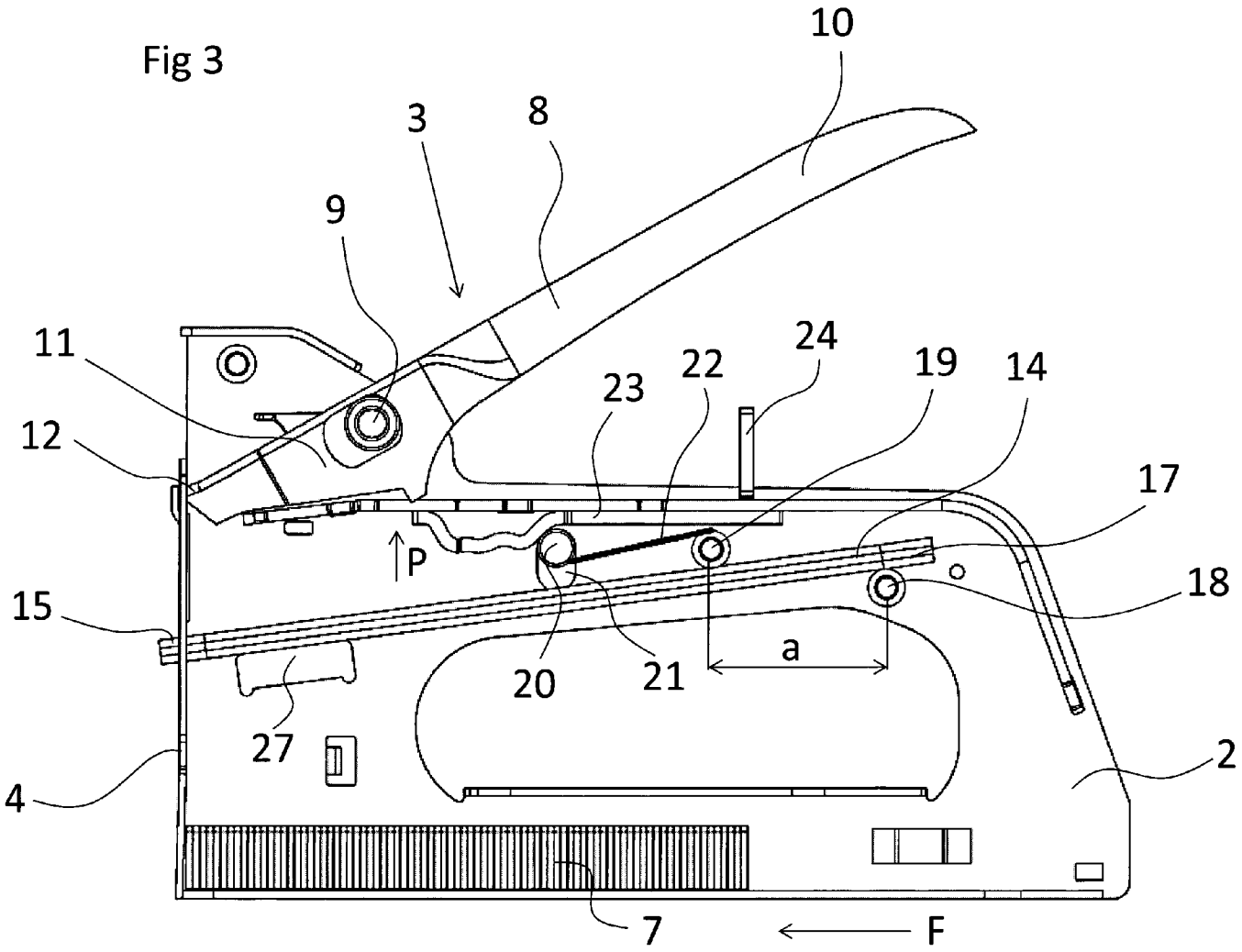
FIGS. 3-5 are side views in which the staple gun is located in a starting position and in which the side facing the observer has been made transparent and in which the second breakpoint pin is located in three different positions.
Figure 4:
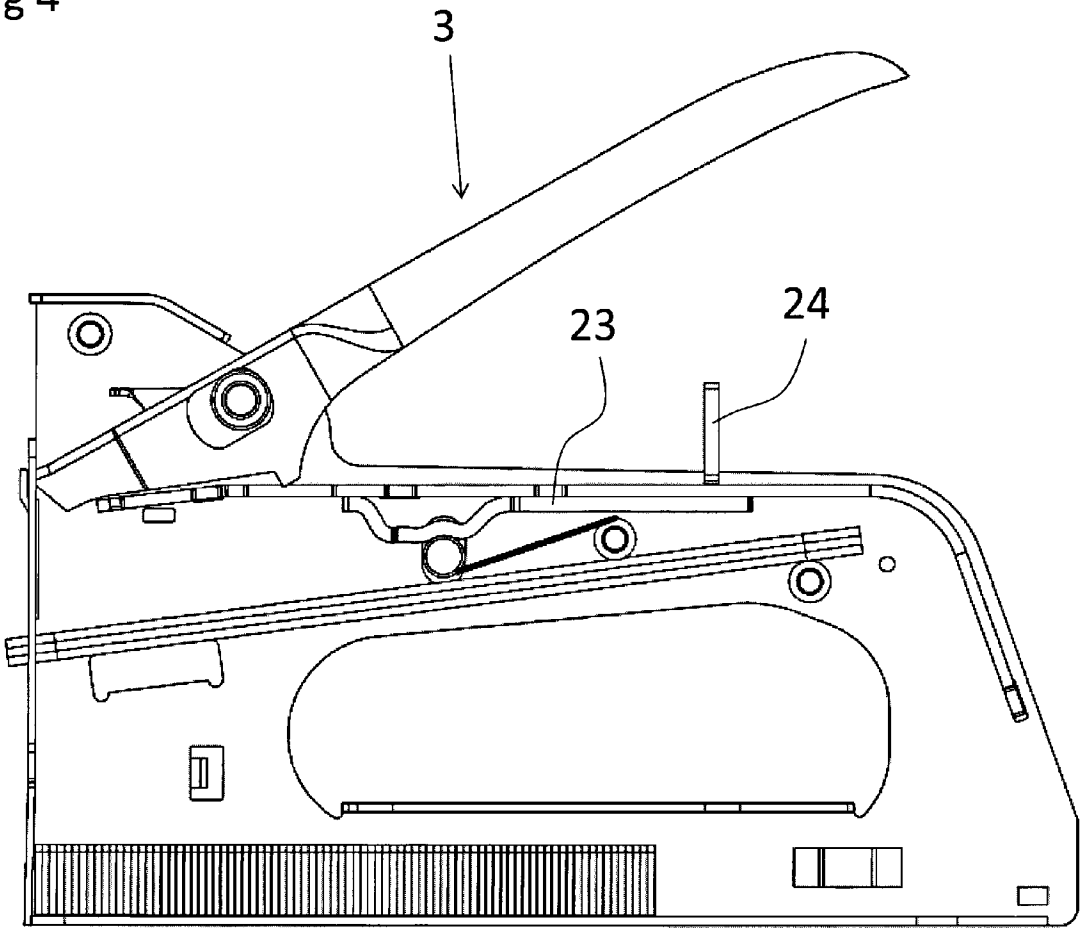
Figure 5:
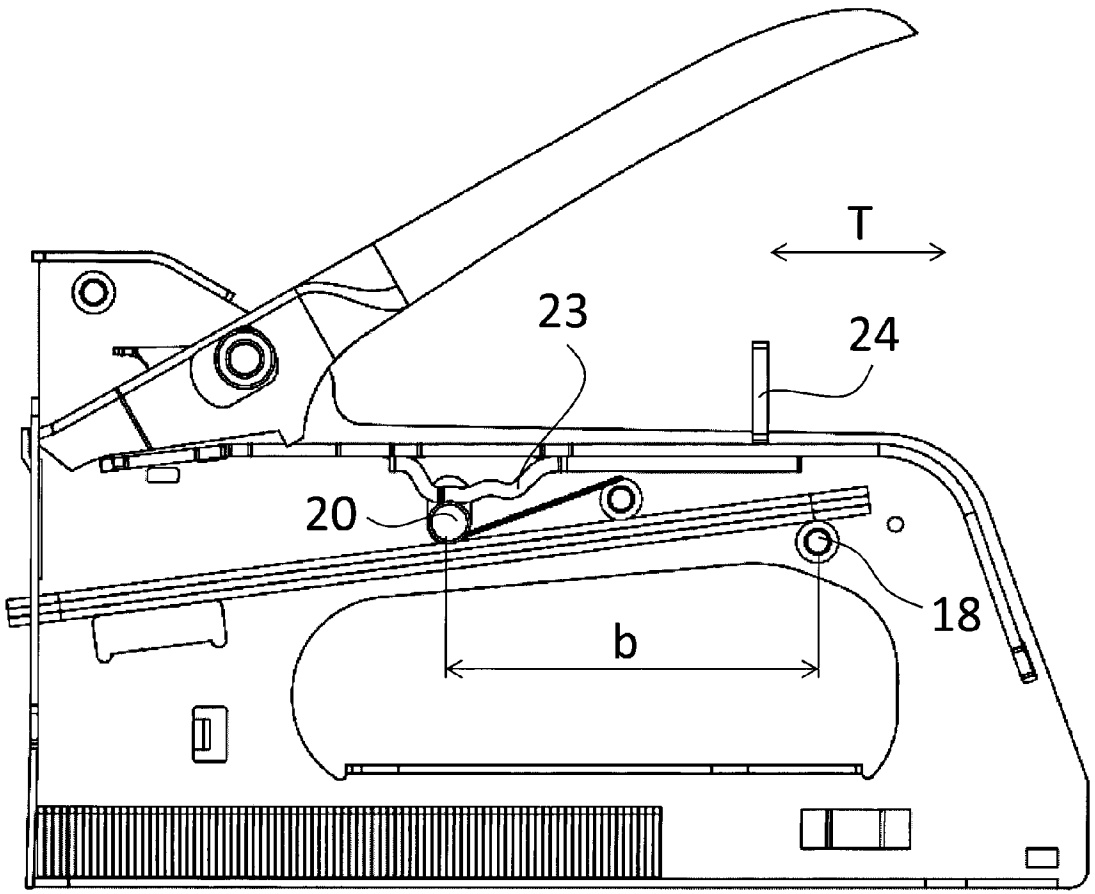

With reference to FIGS. 2-3, the coupling of the driver 4 to the activation member 3 is evident from them. The activation member comprises a lever arm 8, which is rotatably supported to the frame 2 by a rotary pin 9. The lever arm comprises a long arm 10 and a short arm 11. The short arm 11 comprises a tongue 12, which is inserted into a first opening 13 incorporated in the driver 4. Also apparent from the figures is an elongated elastic member 14, which has the form of a leaf spring. The member is coupled at a first end 15 to the driver 4 in such a way that the member is inserted into a second opening 16 arranged to the driver. At its second end 17 the elastic member 14 is in engagement with a bearing pin 18. The frame 2 holds a number of staples 7, which are stored in a magazine arranged in the frame, which magazine is schematically shown in the figures, but which is evident for the person skilled in the art. The staples is fed forward in the direction F by a feed member, which is not visible in the figures but is evident for the person skilled in the art. A first breakpoint pin 19, which is fixedly anchored to the frame and arranged so that it is in contact with the elastic member, is also evident from the figures. Between the bearing pin 18 and the breakpoint pin 19 is a first distance, which is marked by a. Also arranged to the frame is a second breakpoint pin 20, which is arranged movably in a known manner in a long hole 21 to the frame 2 and arranged at a second distance b from the bearing pin 18, see FIG. 5. Extending between the breakpoint pin 19 and the second breakpoint pin 20 is a spring member 22, which is tensioned so that it tries to convey the pin 20 in the direction marked by the arrow P. With reference to FIGS. 3-5, a spacer member 23 is clear from these, which member comprises a manipulating member 24 with which the spacer member can be moved in a manner known to the person skilled in the art in a forward and backward movement T. In FIG. 3, the spacer member is conveyed to the left in the figure and the spring member 22 presses the pin 20 to its highest position in the long hole 21. In FIG. 4, the spacer member is conveyed to a centre position and the member presses the pin 20 against the force from the elastic member to an intermediate position and in FIG. 5 the member has been conveyed furthest to the right and the member has pressed the pin to a lowest position.

Figure 6:
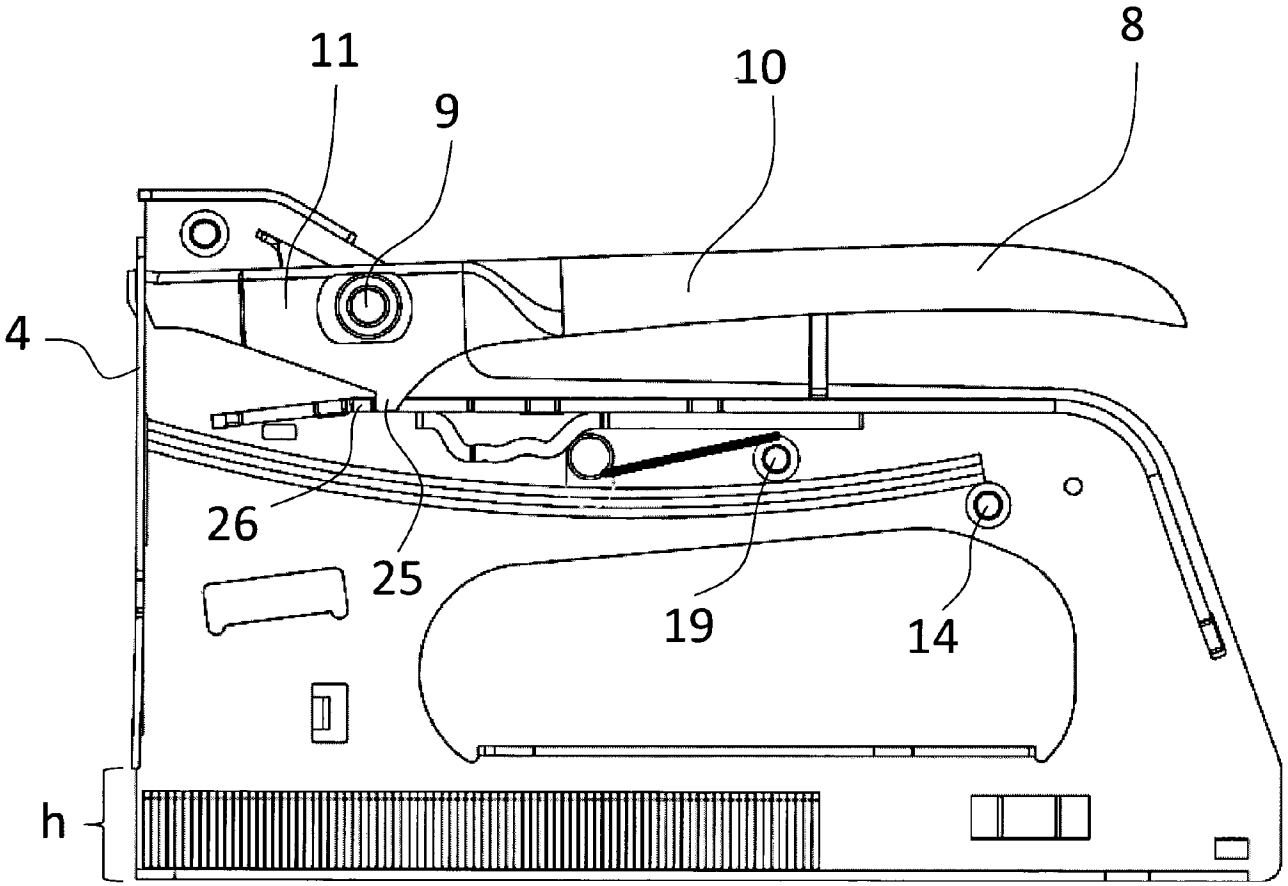
FIGS. 6-8 are views corresponding to FIGS. 3-5 in which the elastic member is tensioned and FIG. 9 shows the staple gun in a position before the driver is moved in its downward movement.
Figure 7:
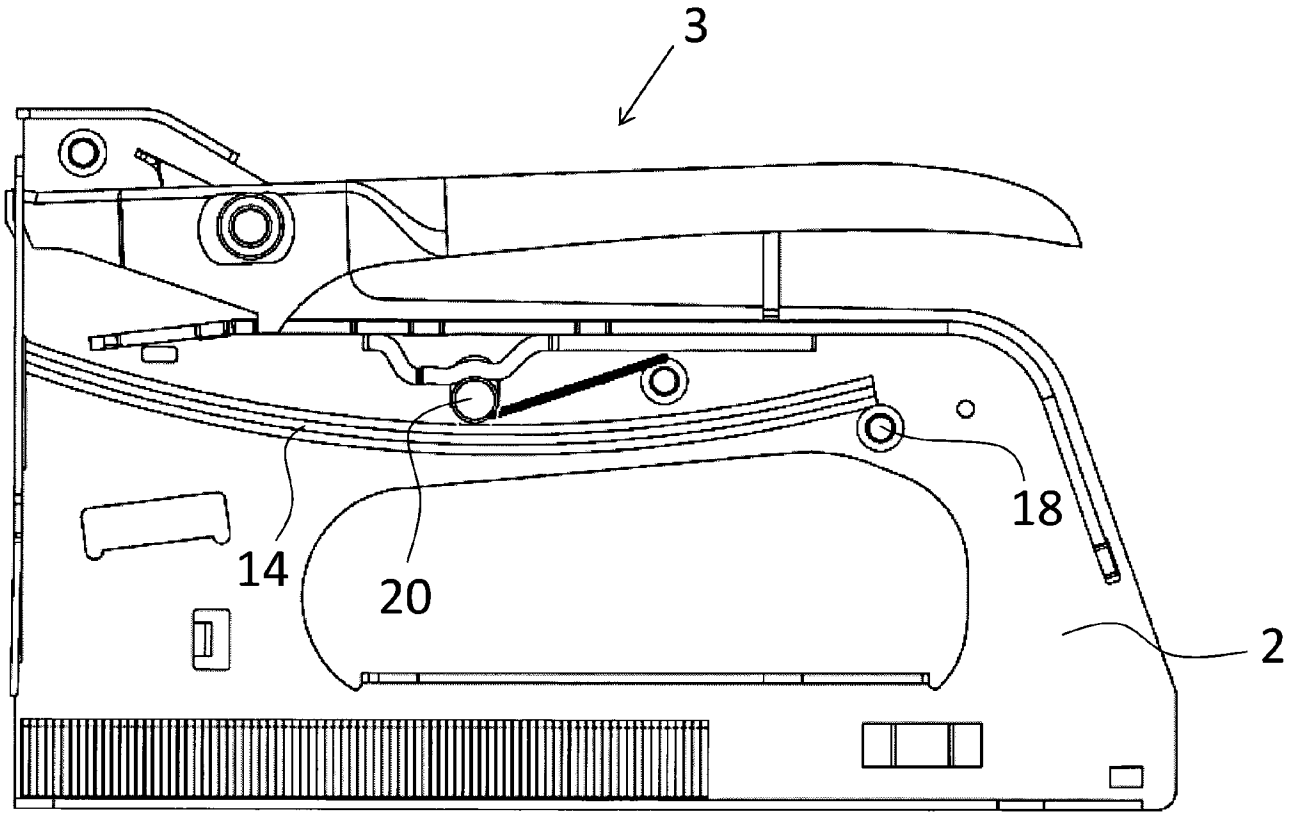
Figure 8:
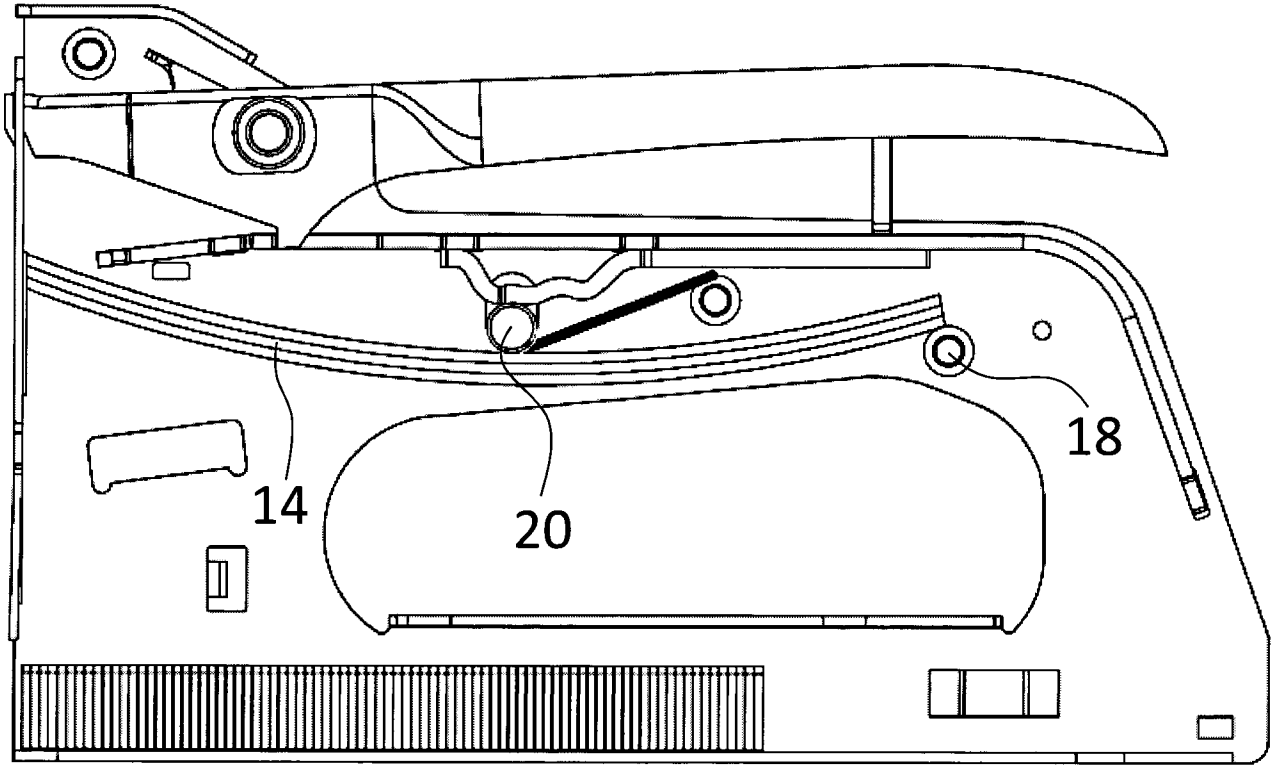
Figure 9:
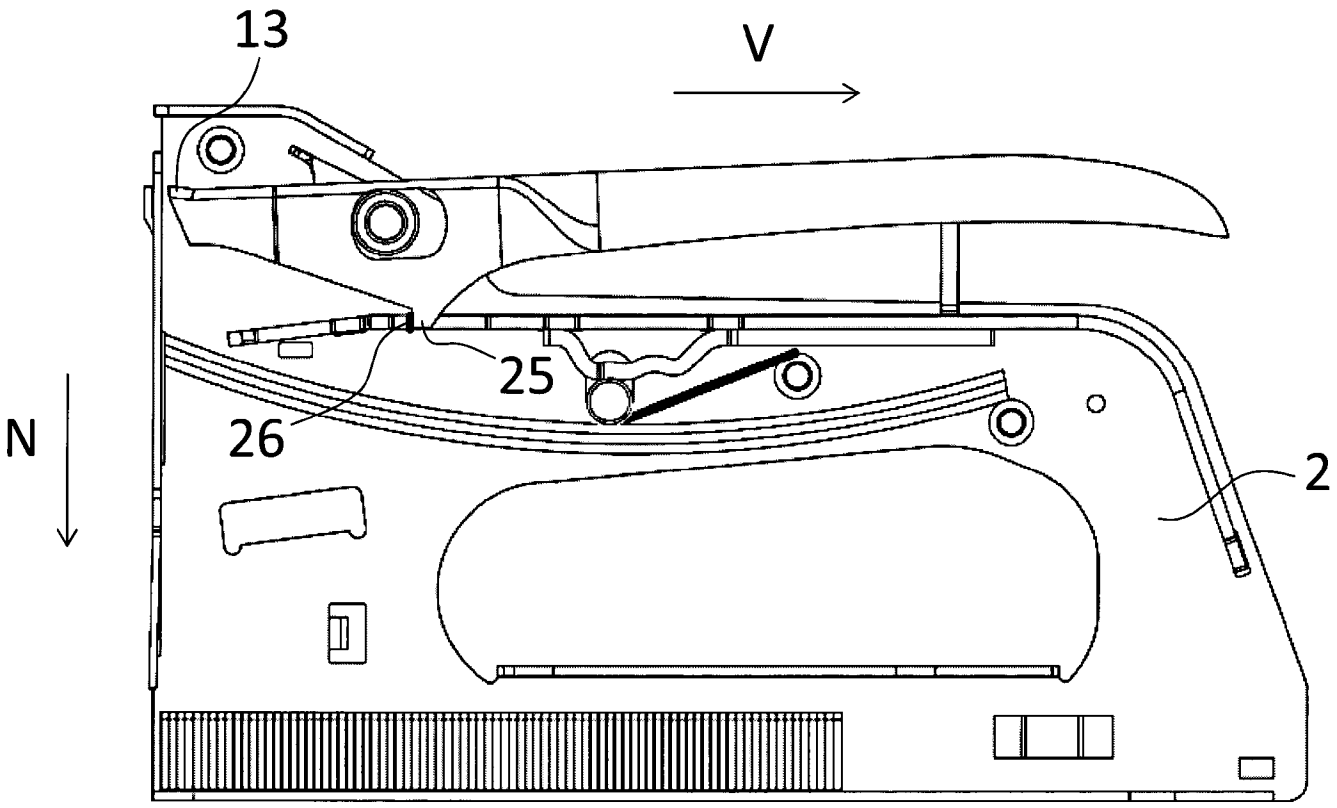

With reference to FIGS. 2, 3 and 6, it is evident from them how the elastic elongated member 14 is tensioned. In FIGS. 2 and 3 the staple gun is located in a starting position, in which the driver is at a bottom position. In these figures the second breakpoint pin 20 is conveyed to its uppermost position and is not in contact with the elongated elastic member. In FIG. 6, the lever arm 8 has been rotated about the pin 9, so that the long arm 10 is brought towards the frame 2 at the same time as the short arm 11 is raised and has thereby raised the driver 4 the distance h, at the same time as the opening 16 has cooperated with the end 15 and raised the elongated elastic member a corresponding distance, with the result that this is bent around the first breakpoint pin 19, due to which the member is tensioned. In this upper position, a heel 25 arranged on the lever arm comes into contact with a stop 26 arranged in the frame, due to which the arm is conveyed in the direction marked by the arrow V, see FIG. 9, due to which the tongue 12 is removed from engagement with the driver and where after the member 14 brings the driver down in a drive stroke, which is marked by the arrow N, to the position shown in FIGS. 2 and 3, and in connection with this a staple is brought into the workpiece that is to be stapled. In this position the elastic member comes to rest against a stop heel 27, which prevents the driver from striking unnecessary marks into the workpiece. In FIG. 5, the second breakpoint pin 20 has been brought down into contact with the elastic elongated member 14 when this is in the starting position and when the activation member raises the driver in an upward movement, the elastic member is bent around the pin 20 and the elastic member is tensioned thereby. In the same way as described above, the driver is raised to the height h, following which the activation member is released from engagement with the driver 4 and the driver is conveyed by the elastic member in a drive stroke N. In FIG. 4, the second breakpoint pin 20 is brought to an intermediate position and the elastic member will meet the pin only after the driver has been conveyed a partial distance of the height h.

By placing the first pin at a distance a from the pin 18, where the ratio a to h is 1.6-2.0:1, it is achieved that the elastic member is only tensioned to such a degree that unnecessary force is not brought against the workpiece when a staple is driven into this. It has proved to be especially advantageous if the ratio is made in the range of 1.7-1.9:1 and the ratio 1.8:1 has proved to be of great value.

For cases where strong tensioning is required, it has proved that such an advantageous tensioning is achieved if the second breakpoint pin is placed at a distance b from the pin 18, where the ratio b to h is 3.1-3.7:1 and the ratio 3.3-3.5:1 has proved especially valuable and the ratio 3.4:1 has proved to be very valuable.

By placing these pins in any of the ratios indicated above, it is achieved that a staple gun with a particularly variable adjustment of the impact force positions is accomplished. Further increased variation is achieved if the second pin is placed in an intermediate position where the elastic member comes into contact with the pin when the driver is raised by 0.4-0.7 h.

The invention is not limited by the above description, but is limited only by the following claims.

The invention claimed is:

1. Staple gun (1) for driving staples (7) into a workpiece (6), which gun comprises a frame (2), arranged in which is a driver (4), which can be conveyed in an up and downward movement and which in the downward movement (N) executes a drive stroke, in which a staple is driven, and which can be conveyed by an activation member (3) in the upward movement (U) to a highest height (h), in which the activation member releases the driver for the execution of the drive stroke, and which driver is coupled to a first end (15) of an elongated elastic member (14), which is tensioned when the driver is conveyed in the upward movement for execution of the drive stroke, and which is in engagement at a second end (17) to a bearing pin (18) arranged to the frame as well as a first breakpoint pin (19) placed between the bearing pin and the driver at a first distance (a) from the bearing pin and around which the elastic member is bent and tensioned when the driver is conveyed in the upward movement, and a second breakpoint pin (20) placed between the driver and the first breakpoint pin at a second distance (b) from the bearing pin (18) and arranged so that it can be conveyed between a first position, in which it does not engage with the elastic member when this is conveyed by the driver in the upward movement, and a second position, in which it engages with the elastic member when the driver is conveyed in the upward movement and tensions the elastic member, wherein the first distance (a) at which the first breakpoint pin (19) is placed from the bearing pin (18) is related to the driver's (4) highest height (h) as 1.6-2.0:1.

2. Staple gun (1) according to claim 1, wherein the first distance (a) at which the first breakpoint pin (19) is placed from the bearing pin (18) is related to the driver's (4) highest height (h) as 1.7-1.9:1.

3. Staple gun (1) according to claim 1, wherein the first distance (a) at which the first breakpoint pin (19) is placed from the bearing pin (18) is related to the driver's (4) highest height (h) as 1.8:1.

4. Staple gun (1) according to claim 1, wherein the second distance (b) at which the second breakpoint pin (20) is placed from the bearing pin (18) is related to the driver's (4) highest height (h) as 3.1-3.7:1.

5. Staple gun (1) according to claim 4, wherein the second breakpoint pin (20) is placed so that it comes into contact with the elastic member (14) when the driver (4) is raised by the activation member (3) to 40-70% of the driver's (4) highest height (h).

6. Staple gun (1) according to claim 1, wherein the second distance (b) at which the second breakpoint pin (20) is placed from the bearing pin (18) is related to the driver's (4) highest height (h) as 3.3-3.5:1.

7. Staple gun (1) according to claim 1, wherein the second distance (b) at which the second breakpoint pin (20) is placed from the bearing pin (18) is related to the driver's (4) highest height (h) as 3.4:1.

* * * * *